US008562393B2

(12) United States Patent
Giovanardi

(10) Patent No.: US 8,562,393 B2
(45) Date of Patent: Oct. 22, 2013

(54) SHOT-BLASTING MACHINE FOR SURFACE TREATMENT OF PRODUCTS

(75) Inventor: Paola Giovanardi, Modena (IT)

(73) Assignee: C.M. Surface Treatment—Societa'per Azioni, Modena (IT)

( * ) Notice: Subject to any disclaimer, the term of this patent is extended or adjusted under 35 U.S.C. 154(b) by 941 days.

(21) Appl. No.: 12/452,865

(22) PCT Filed: Jul. 18, 2008

(86) PCT No.: PCT/IB2008/001879

§ 371 (c)(1),
(2), (4) Date: Jan. 26, 2010

(87) PCT Pub. No.: WO2009/016448

PCT Pub. Date: Feb. 5, 2009

(65) Prior Publication Data

US 2010/0130110 A1 May 27, 2010

(30) Foreign Application Priority Data

Jul. 27, 2007 (IT) ..... MO2007A00249

(51) Int. Cl.
*B24C 3/08* (2006.01)

(52) U.S. Cl.
USPC ..... 451/81; 451/75; 451/89; 451/91; 451/336; 451/339; 451/95; 451/97

(58) Field of Classification Search
USPC ..... 451/38, 80, 81, 82, 84, 86, 89, 91, 94, 451/95, 97, 75, 336, 339
See application file for complete search history.

(56) References Cited

U.S. PATENT DOCUMENTS

| | | | | | |
|---|---|---|---|---|---|
| 4,018,006 | A | * | 4/1977 | Moelders | 451/82 |
| 4,037,364 | A | | 7/1977 | Freeman et al. | |
| 4,121,387 | A | * | 10/1978 | Weis et al. | 451/81 |
| 4,326,362 | A | * | 4/1982 | Williams et al. | 451/80 |
| 5,142,830 | A | * | 9/1992 | Carpenter | 451/82 |
| 5,361,548 | A | * | 11/1994 | Kuehn | 451/76 |
| 5,512,005 | A | * | 4/1996 | Gulling | 451/29 |

FOREIGN PATENT DOCUMENTS

| | | |
|---|---|---|
| CH | 482 510 | 12/1969 |
| GB | 1 191 154 | 5/1970 |
| GB | 1 242 933 | 8/1971 |

OTHER PUBLICATIONS

International Search Report.

* cited by examiner

*Primary Examiner* — Eileen P. Morgan
(74) *Attorney, Agent, or Firm* — Collard & Roe, P.C.

(57) ABSTRACT

The shot-blasting machine for surface treatment of products comprises a base frame, a containing chamber for containing at least a product to be treated associated to the base frame and provided with at least an access opening, one or more projecting organs associated internally of the chamber for projecting a flow of shot-blasting particles onto the product, and automated unloading means associated to the base frame which cause the product to exit from the chamber through the access opening.

27 Claims, 7 Drawing Sheets

SHOT-BLASTING MACHINE FOR SURFACE TREATMENT OF PRODUCTS

CROSS REFERENCE TO RELATED APPLICATIONS

This application is the National Stage of PCT/IB2008/001879 filed on Jul. 18, 2008, which claims priority under 35 U.S.C. §119 of Italian Application No. MO2007A000249 filed on Jul. 27, 2007.

TECHNICAL FIELD

The invention relates to a shot-blasting machine for surface treatment of products.

PRIOR ART

As is known, shot-blasting machines, using a compressed-air propelling system, or a system based on centrifugal force, project particles against a surface of one or more products, generating a surface treatment which can be cleaning, roughening, deburring and/or hardening (shot-peening).

The particles which are projected against the products are usually generically known as "grit", and consist in an abrasive mixture of sand, pumice, glass, steel shots and/or other materials of various granulometry according to the type of finishing required.

The fields of use of the machines are very varied indeed, according to the type of treatment to be carried out.

Some examples of products or working which use these machines are the following: cleaning and sanding of casts, descaling of steels and non-ferrous alloys, preparation for enamelling and/or galvanising, rusticating stones or agglomerates, shot-blasting tools, springs, leaf-springs, motor-car wheel rim surface finishing, etc.

Traditional shot-blasting machines are in general made up of a containing chamber for containing the products to be treated, internally of which the projecting organs are located, which projecting organs are of the mechanical turbine or nozzle type operating by compressed air, which project the grit against the products.

Product moving organs are usually included internally of the containing chamber, which enable the products to be moved with respect to the projecting organs so that the whole surface of the products can be struck by the flow of grit being shot.

The moving organs are of known type and consist in turntables, roller planes, conveyor belts, hooks on a monorail and others.

The loading of the shot-blasting machines with the products to be treated and the unloading of the treated products is usually done manually by specialised personnel.

This manual activity, however, has various drawbacks, such as e.g. the need to have available the actual member of personnel, leading to a relevant cost for what are after all repetitive, little-rewarding and at times tiring work operations. To obviate these drawbacks, the prior art includes combining shot-blasting machines with separate machines dedicated to the manipulation of the products, such as for example articulated robots provided with claws that can grip the products to be treated, locate them in the containing chamber before the start of treatment, and extract them at the end of the operations.

This product loading and unloading system is also not without drawbacks.

One drawback is that articulated robots have considerably space-consuming dimensions and in order to operate they require a certain amount of working space in the vicinity thereof.

This drawback is particularly noted in those plants in which a large number of products have to be moved rapidly, and in which for this aim fork-lift trucks or other lifting devices are used, which require large maneuvering spaces and wide avenues to move in.

Another noteworthy point is that plants equipped with articulated robots are subject to particularly high installation, control/management and maintenance costs, which have a negative influence on the final cost of the treated products. It is also stressed that the need to combine two separate machines, i.e. a shot-blaster and an articulated robot, leads to the inconvenient need to connect and interface the operation of one machine with that of the other, and this operation is not always rapid and immediate to set up.

OBJECT OF THE INVENTION

The main aim of the present invention is to provide a shot-blasting machine for surface treatment of products, which machine treats a large number of products in a practical, simple and functional way, without any need for substantial use of personnel and which, at the same time, is of an especially limited size.

A further object of the present invention is to operate with very contained installation, management and maintenance costs.

A further object of the present invention is to provide a shot-blasting machine for surface treatment of products which enables the above-mentioned drawbacks in the prior art to be obviated, with a simple and rational solution which is also simple and effective to use.

The above-described objects are all attained by the present shot-blasting machine for surface treatment of products, comprising at least a base frame, at least a containing chamber for containing at least a product to be treated associated to said base frame and provided with at least an access opening, at least a projecting organ being associated internally of said chamber and suitable for projecting a flow of shot-blasting particles onto said product, characterised in that it comprises automated unloading means associated to said base frame and suitable for unloading said product from said chamber through said access opening.

BRIEF DESCRIPTION OF THE DRAWINGS

Further characteristics and advantages of the present invention will better emerge from the description that follows of a preferred but not exclusive embodiment, of a shot-blasting machine for surface treatment of products, illustrated by way of non-limiting example in the accompanying figures of the drawings, in which.

PREFERRED EMBODIMENTS OF THE INVENTION

Figure 1:
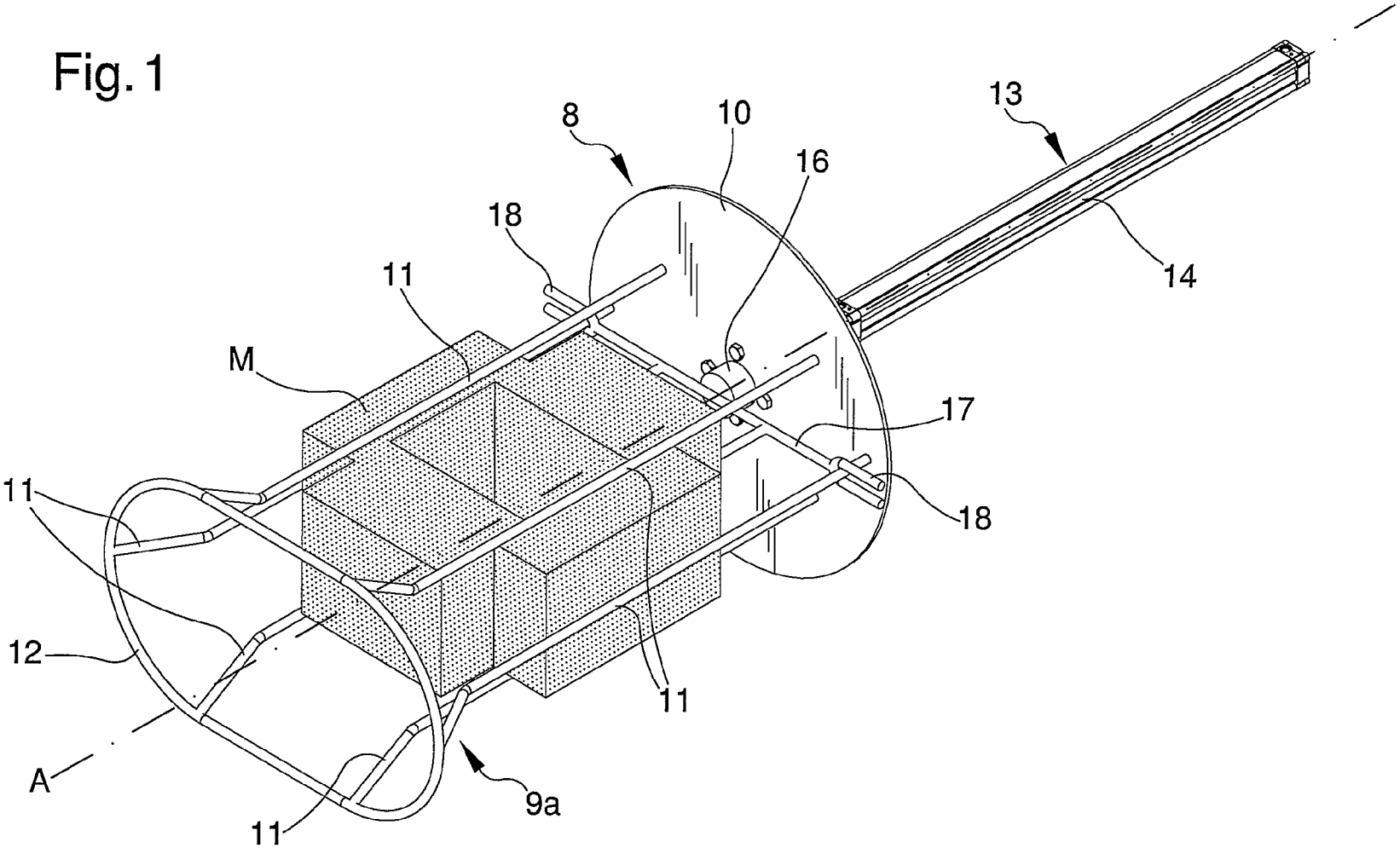
FIG. 1 is an axonometric view of the automated unloading means provided on the machine according to the invention in the first work position.

With special reference to the figures of the drawings, 1 denotes in its entirety a shot-blasting machine for surface treatment of products.

The machine 1 is destined to be associated to an advancement line 2 of products M to be treated, e.g. a conveyor belt or a roller plane.

The advancement line 2 defines in practice a substantially horizontal plane 3 for moving the products M.

In more detail, the machine 1 comprises a base frame 4 which supports a containing chamber 5 for containing the products M which is arranged by a side of the advancement line 2.

An access opening 6 is afforded on a wall of the chamber 5 which wall faces the advancement line 2 of the products M, through which opening 6 the products M can both enter and exit the chamber 5.

The access opening 6 is arranged substantially at the same height from the ground as the plane 3, such that at least a portion of the advancement line 2 is arranged in front of the access opening 6.

A series of projecting organs 7 is mounted internally of the chamber 5, for projecting a flow of shot-blasting particles onto the product M which is located in the chamber 5.

The projecting organs 7 are usefully of a type having a centrifuging action and consist in mechanical turbines; however, in other embodiments of the present invention the projecting organs 7 could operate with compressed air and be constituted by nozzles.

Rotating means 8 are also provided internally of the chamber 5, which rotating means 8 turn the products M around a work axis A which is horizontal or slightly inclined.

The rotating means 8 consist, for example, of a cage element 9*a*, which snugly contains a product M, and of a device 9*b* for rotating the cage element 9*a* around the work axis A.

The cage element 9*a* is, in detail, defined by a substantially circular plate 10 arranged vertically and facing the access opening 6 and by a plurality of horizontal bars 11 which extend from the plate 10 towards the access opening 6. The end 12 of the cage element 9*a* opposite the plate 10 is facing towards the access opening 6, is open and is substantially flared, i.e. the bars 11 are bent and inclined along centrifugal directions with respect to the work axis A.

The flaring of the cage element 9*a* defines a mouth for introducing products M into the cage element 9*a*.

The machine 1 advantageously comprises automated unloading means 13 for removing the products M from the chamber 5 through the access opening 6.

The automated unloading means 13, e.g., are constituted by a pusher element which is mounted internally of the chamber 5 and which pushes the products M through the access opening 6 in order to position them on the advancement line 2 at the conclusion of the work operations performed in the chamber 5.

The pusher element 13, in detail, consists of a first linear actuator, of a fluid-operating jack type, the liner 14 of which is solidly mounted on the chamber 5 and the stem 15 of which is arranged to pass through the plate 10 to push a mobile end 16.

The first linear actuator extends horizontally along the work axis A.

The mobile end 16 inserts internally of the cage element 9*a* and, by effect of the thrust of the pusher element 13, can be moved between a first work position arranged in proximity of the plate 10 and a second work position arranged in proximity of the open end 12.

The mobile end 16 is mounted on the stem 15 and is rotatable around the work axis A and is in turn solidly associated to a pusher body 17 which enters into contact with the products M during the stage of expulsion thereof from the chamber 5.

The pusher body 17 is constituted, for example, by a transversal rod which is transversal to the work axis A, terminal parts 18 of which rod are forked and arranged forkingly about two bars 11 such as to function as a guide during sliding of the transversal rod 17 along the cage element 9*a*.

Further embodiments (not illustrated in the figures) are not, however, excluded, in which the terminal parts 18, though continuing to function as guides along the bars 11, are differently shaped, for example in loops, bushes, sleeves or the like.

The machine 1 is advantageously further provided with automated loading means 19, which enable entry of the products M in the chamber 5 through the access opening 6.

Figure 2:
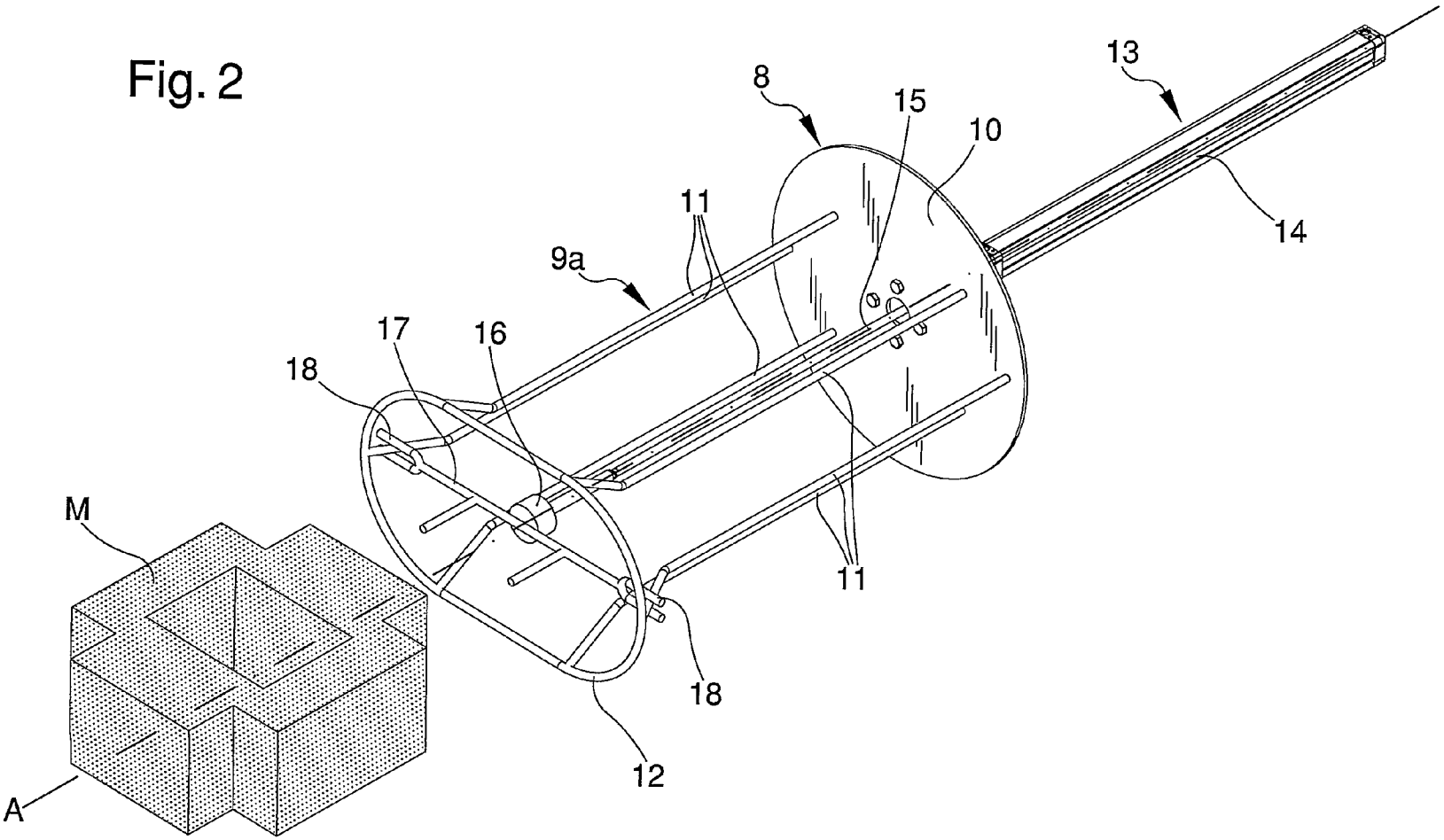
FIG. 2 is an axonometric view of the automated unloading means of FIG. 1, in the second work position.
Figure 3:
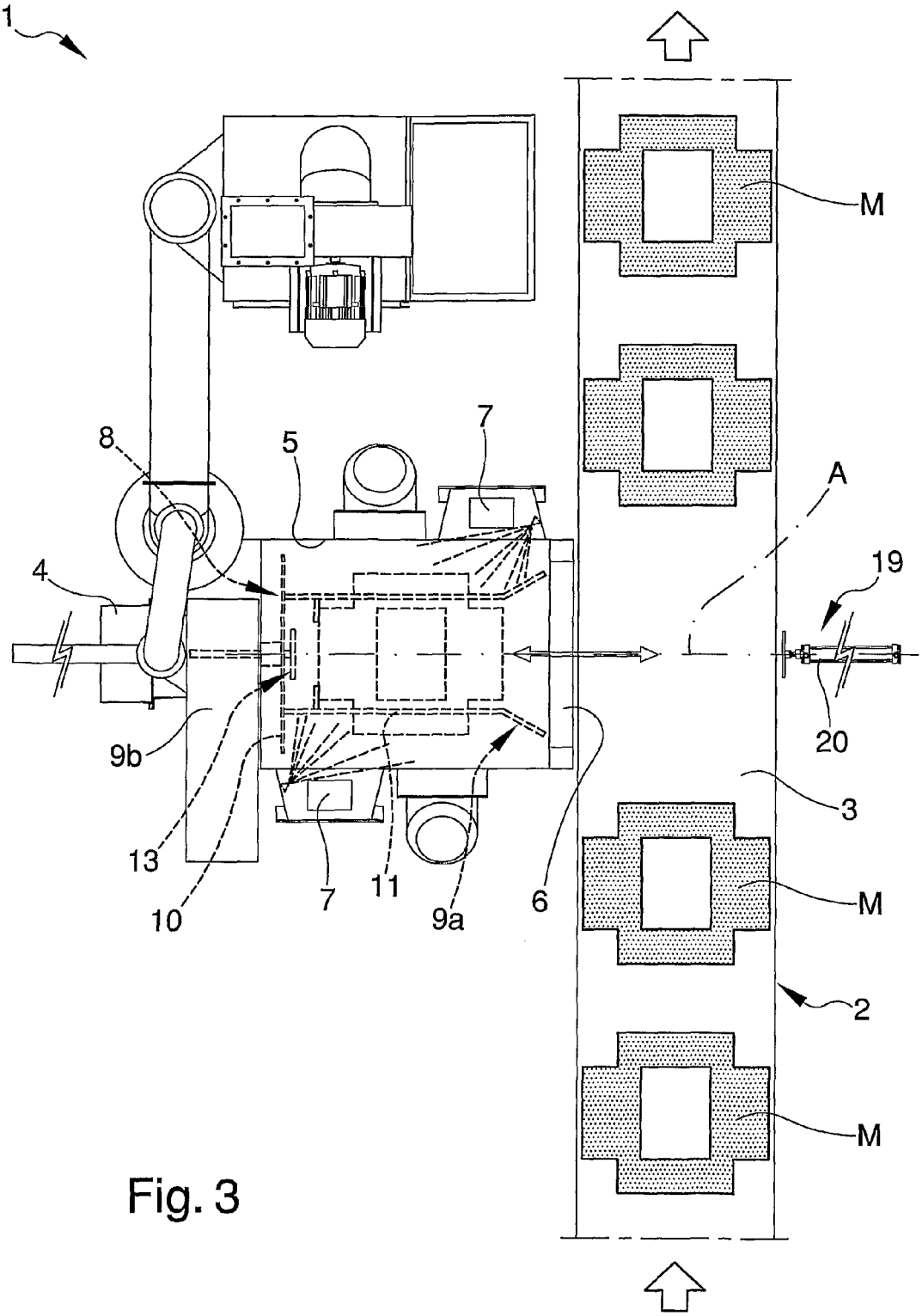
FIG. 3 is a plan view, partially transparent, of a special embodiment of the machine according to the invention.
Figure 4:
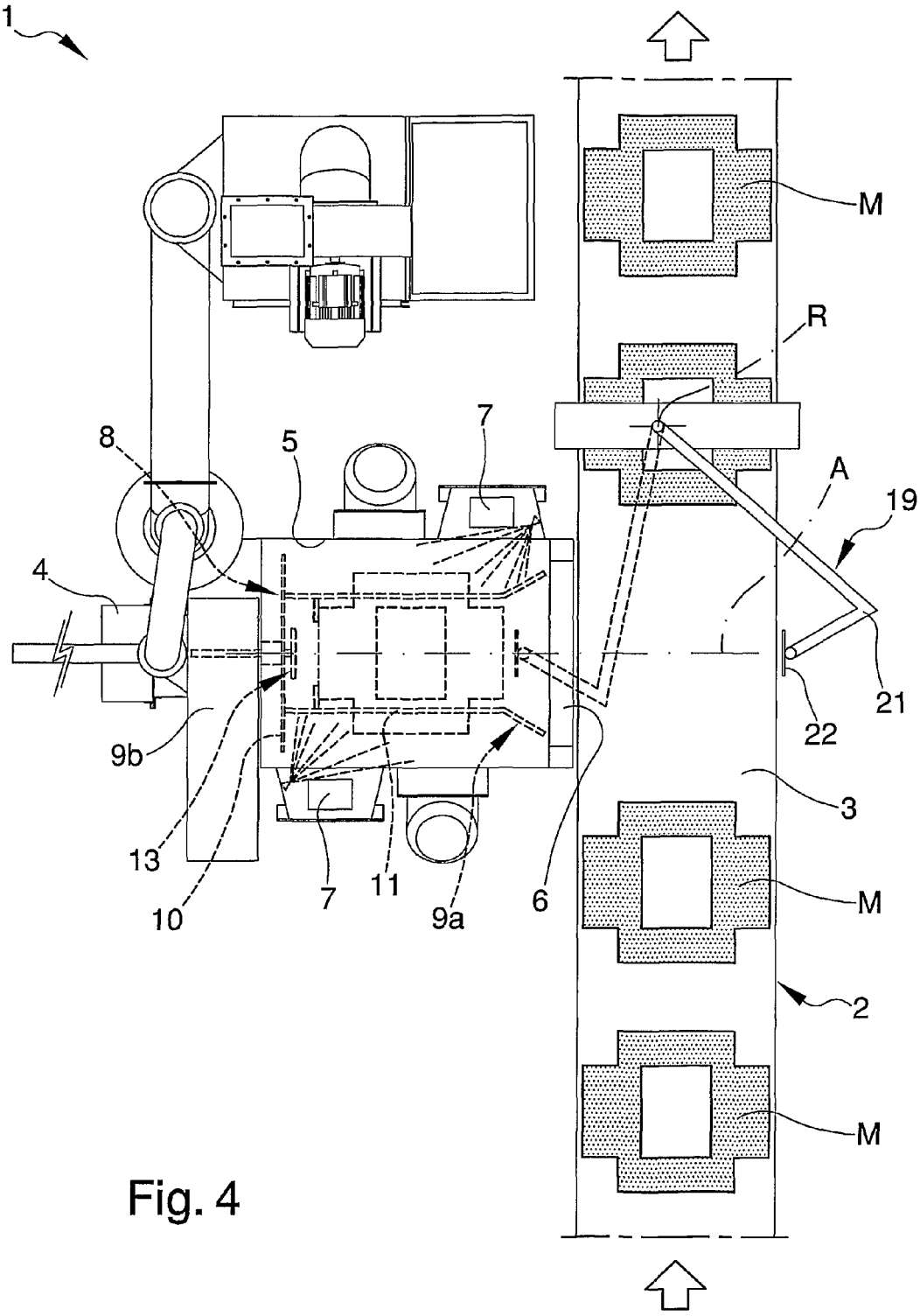
FIG. 4 is a plan view, partially transparent, of an alternative embodiment of the machine according to the invention.

In the particular embodiments of the invention, illustrated in FIGS. 3 and 4, e.g., the machine 1 is provided with automated unloading means 13 as illustrated in FIGS. 1 and 2, while the automated loading means 19 consist in a drawing device mounted externally of the chamber 5 and suitable for pushing the products M through the access opening 6.

In the embodiment of the invention illustrated in FIG. 3, the drawing device 19 is constituted, e.g., by a second linear actuator 20, of the fluid-operating jack type, which faces the access opening 6 and is arranged substantially horizontal and transversal to the opening, on an opposite side of the advancement line 2. In the embodiment of the invention illustrated in FIG. 4, the drawing device 19 comprises an arm 21 associated to the base frame 4, rotatably around a vertical rotation axis R.

The free end of the arm 21 substantially faces the access opening 6 and a pusher plate 22 is mounted thereon, which pusher plate 22 pushes the products M internally of the chamber 5 when the arm 21 is set in rotation.

The machine 1 as illustrated in FIGS. 3 and 4 functions as follows.

The products M reach the machine 1 in succession on the advancement line 2. When the first product M to be worked is arranged facing the access opening 6, the drawing device 19 pushes it internally of the chamber 5 and, in particular, internally of the cage element 9*a* which is aligned with the access opening 6 and which initially has the mobile end 16 thereof arranged in the first work position. During the shot-blasting operation, the projecting organs 7 shoot the shot-blasting particles against the product M and at the same time the product M is set in rotation around the work axis A by the cage element 9*a*.

When the working process is finished, the product M is expelled by extension of the first linear actuator 13 which displaces the mobile end 16 from the first to the second work position.

The just-worked product M is then returned to the advancement line 2, on which it can be distanced and sent on to following work stations.

Figure 5:
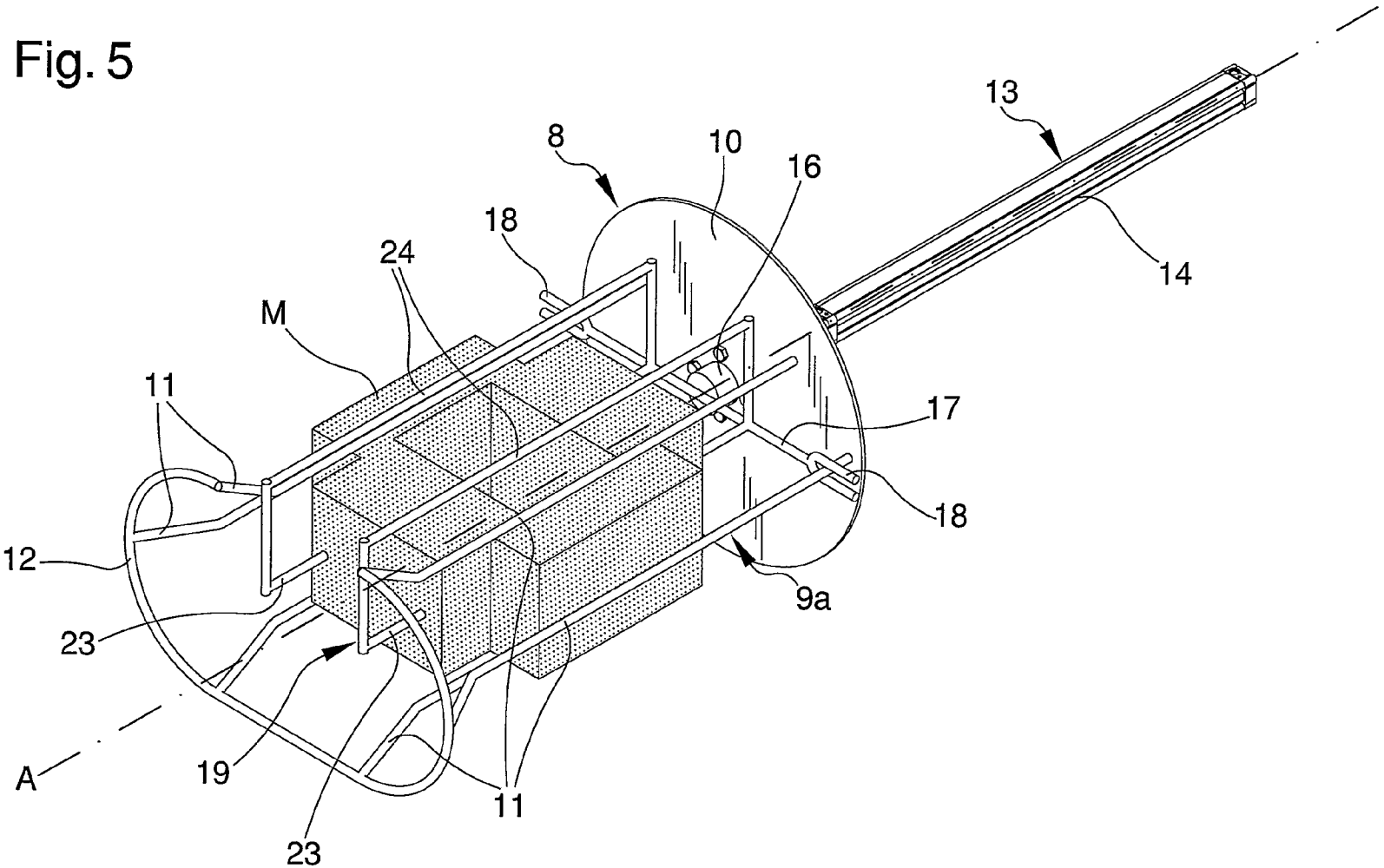
FIG. 5 is an axonometric view of a detail of a further embodiment of the machine according to the invention in the first work position.
Figure 6:
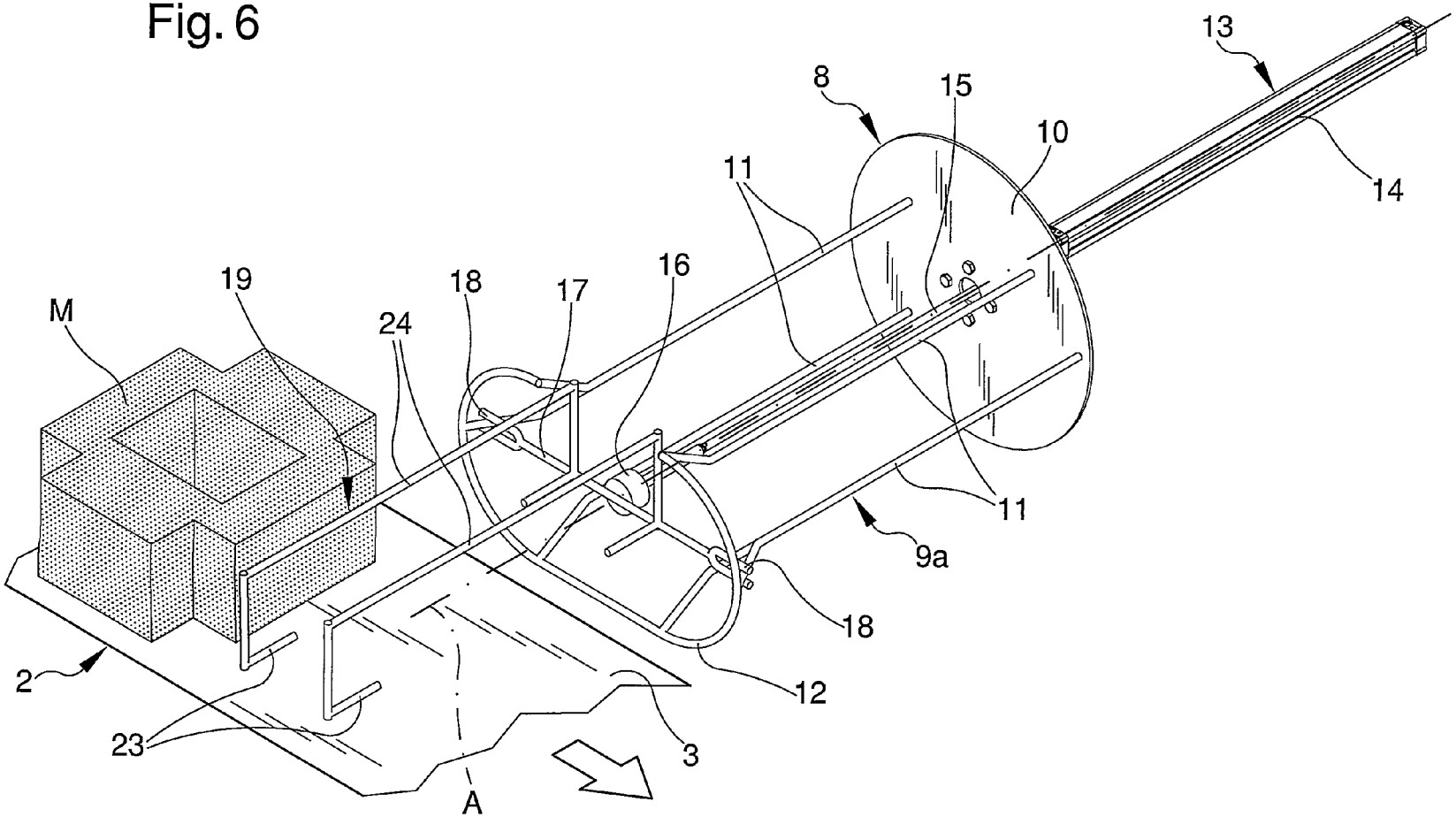
FIG. 6 is an axonometric view of the detail of FIG. 5 in the second work position.
Figure 7:
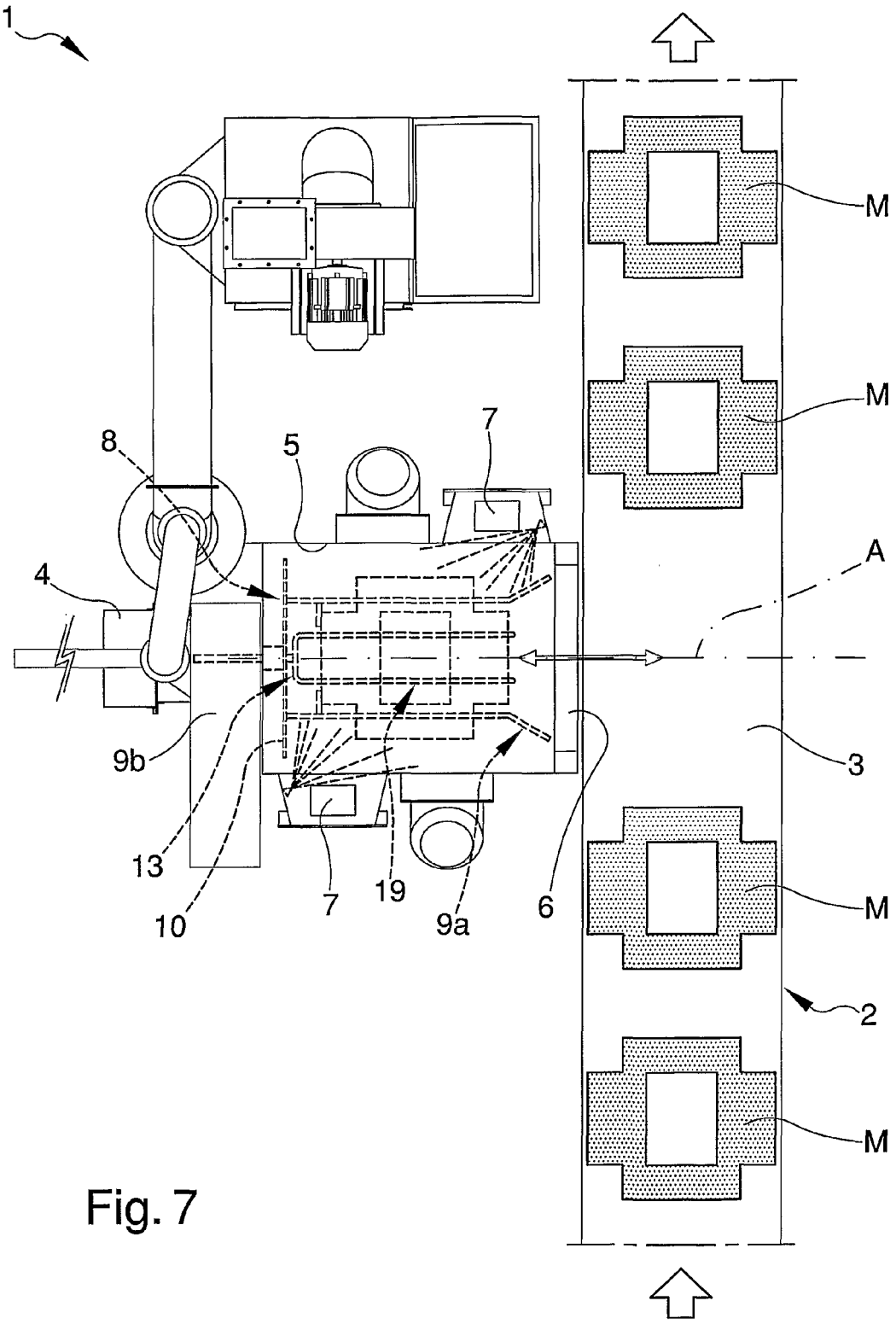
FIG. 7 is a plan view, partially transparent, of the embodiment of FIGS. 5 and 6.

In a further embodiment of the invention, illustrated in FIG. 7, the machine 1 is provided with automated unloading means 13 and automated loading means 19 which are united to one another and represented in detail in FIGS. 5 and 6. Similarly to the above-described embodiments, the automated unloading means 13 are constituted by the pusher element 13 which displaces the mobile end 16 between the first work position (FIG. 5) and the second work position (FIG. 6) such as to push the transversal rod 17 in order to expel the products M from the chamber 5.

The automated loading means 19, on the other hand, consist of a gripping structure for the products M which is solidly constrained to the transversal rod 17 and is movable therewith between the first and the second work positions. The gripping structure 19 consists of a bridge-shaped frame, which in the second work position is locatable in a forked position with respect to the advancement line 2.

The frame is constituted by a pair of contact elements 23, located at a distance from the pusher body 17 on an opposite side with respect to the pusher element 13, and by two connecting sections 24, which connect the contact elements 23 with the transversal rod 17.

In practice, the gripping structure 19 is of such size and shape that the products M to be worked can be located substantially snugly between the contact elements 23 and the pusher body 17.

The functioning of the machine 1 as illustrated in FIG. 7 is the following. During the stage of introducing the products M in the chamber 5, the mobile end 16 is arranged in the second work position with the gripping structure 19 arranged forked over the advancement line 2.

The activation of the advancement line 2 causes the products M to reach the machine 1 up until one thereof is located between the contact elements 23 and the pusher body 17.

At this point, the pusher element 13 is activated from the second work position into the first work position, which draws the gripping structure 19 and with it the product M internally of the chamber 5 and the cage element 9*a*.

On completion of the shot-blasting operation, inverse activation of the pusher element 13 from the first into the second work position means the worked product M can be expelled and returned to the advancement line 2, and subsequent work operations can be performed thereon.

It has in point of fact being ascertained how the described invention achieves the proposed objects.

The invention thus conceived is susceptible to numerous modifications and variations, all of which falling within the scope of the inventive concept. Furthermore all the details can be replaced with others that are technically equivalent.

In practice, the materials used, as well as the contingent shapes and dimensions, may be any according to requirements without because of this moving outside the protection scope of the following claims.

The invention claimed is:

1. A shot-blasting machine for surface treatment of products, comprising:

at least a base frame;

at least a containing chamber for containing at least a product to be treated, said chamber being associated to said base frame and provided with at least an access opening, with at least a projecting organ being associated internally of said chamber and suitable for projecting a flow of shot-blasting particles onto said product;

rotating means for rotating said product around a substantially horizontal work axis arranged internally to said chamber, said rotating means comprising a cage element, arranged in said chamber, suitable for containing said product and provided with an open end facing towards said access opening of said chamber and with a closed end opposite to said open end; and automated unloading means associated to said base frame and suitable for unloading said product once treated, from said cage element, arranged in said chamber, through said open end and said access opening;

wherein said automated unloading means comprise at least a pusher element mounted internally of said chamber and suitable for pushing said product through said open end and said access opening; and said pusher element comprises at least a mobile end which is insertable internally of said cage element and is movable between a first work position arranged substantially in proximity of said closed end and a second work position arranged substantially in proximity of said open end;

wherein it comprises automated loading means for entry of said product into said chamber through said access opening;

wherein said automated loading means and said automated unloading means are united to one another;

wherein said automated loading means comprise a gripping structure for gripping said product associable to said pusher element;

wherein said gripping structure is associable to said mobile end and is movable there-with between said first work position and said second work position;

wherein:

said pusher element comprises at least a pusher body associated to said mobile end and suitable for entering into contact with said product; and said gripping structure comprises at least a contact element located substantially distanced from said pusher body on a substantially opposite side with respect to said pusher element and at least a connecting section for connecting said contact element with said pusher body, said product being locatable between said contact element and said pusher body.

2. The machine according to claim 1, wherein said cage element is substantially flared at said open end thereof.

3. The machine according to claim 1, wherein said rotating means comprise at least a rotating device for rotating said cage element around said work axis.

4. The machine according to claim 1, wherein said cage element comprises at least a substantially-vertical plate facing said access opening and a plurality of substantially-horizontal bars which extend from said plate towards said access opening.

5. The machine according to claim 1, wherein said pusher element is associated to said cage element and is rotatable there-with.

6. The machine according to claim 1, wherein said pusher element comprises at least a pusher body associated to said mobile end and suitable for entering into contact with said product.

7. The machine according to claim 6, wherein:

said cage element comprises at least a substantially-vertical plate facing said access opening and a plurality of substantially-horizontal bars which extend from said plate towards said access opening; and said pusher body comprises at least a rod which is substantially transversal to said bars.

8. The machine according to claim 7, wherein at least one of the terminal parts of said rod is fork-shaped and arranged forking about one of said bars.

9. The machine according to claim 7, wherein at least one of the terminal parts of said rod is shaped as a loop, as a bush, as a sleeve or a like element, and is arranged around one of said bars.

10. The machine according to claim 1, wherein said pusher element comprises at least a first linear actuator.

11. The machine according to claim 10, wherein said first linear actuator is arranged substantially horizontally.

12. The machine according to claim 11, wherein said first linear actuator is arranged along said work axis.

13. The machine according to claim 10, wherein said first linear actuator comprises at least a fluid-operating jack.

14. The machine according to claim 13, wherein said fluid-operating jack comprises a liner which is solidly associated to said chamber and a stem which is rotatably associated to said mobile end.

15. The machine according to claim 1, wherein the automated loading means comprise at least a drawing device mounted externally of said chamber and suitable for pushing said product through said access opening.

16. The machine according to claim 15, wherein said drawing device comprises at least a second linear actuator which is substantially facing said access opening.

17. The machine according to claim 16, wherein said second linear actuator is arranged substantially horizontally and transversally of said access opening.

18. The machine according to claim 16, wherein said second linear actuator comprises at least a fluid-operating jack.

19. The machine according to claim 15, wherein said drawing device comprises at least an arm rotatably associated to said base frame, the free end of which substantially faces said access opening and is suitable for pushing said product internally of said chamber.

20. The machine according to claim 19, wherein said arm is rotatable around a substantially-vertical rotation axis.

21. The machine according to claim 1, wherein said machine is associable to an advancement line of said products.

22. The machine according to claim 21, wherein at least a portion of said advancement line is arranged in front of said access opening.

23. The machine according to claim 1, wherein said machine is associable to an advancement line of said products, in said second work position said gripping structure being substantially locatable in a forked position about said advancement line.

24. The machine according to claim 1, wherein said projecting organ has a centrifuge action.

25. The machine according to claim 24, wherein said projecting organ having a centrifuge action comprises a mechanical turbine.

26. The machine according to claim 1, wherein said projecting organ has an action based on compressed air.

27. The machine according to claim 26, wherein said projecting organ based on compressed air comprises a nozzle.

* * * * *